US010364525B2

(12) United States Patent
Kehl et al.

(10) Patent No.: US 10,364,525 B2
(45) Date of Patent: Jul. 30, 2019

(54) LAUNDRY TREATING APPLIANCE LINT FILTER

(71) Applicant: WHIRLPOOL CORPORATION, Benton Harbor, MI (US)

(72) Inventors: Dennis Kehl, Benton Harbor, MI (US); Andrew Leitert, Eau Claire, MI (US); Lonnie J. Richman, Painesville, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 53 days.

(21) Appl. No.: 15/638,561

(22) Filed: Jun. 30, 2017

(65) Prior Publication Data

US 2017/0298561 A1 Oct. 19, 2017

Related U.S. Application Data

(62) Division of application No. 14/687,065, filed on Apr. 15, 2015, now Pat. No. 9,725,845.

(51) Int. Cl.

| | |
|---|---|
| ***D06F 39/02*** | (2006.01) |
| ***D06F 25/00*** | (2006.01) |
| ***D06F 58/22*** | (2006.01) |
| *D06F 33/02* | (2006.01) |

(52) U.S. Cl.

CPC ..... *D06F 39/022* (2013.01); *D06F 25/00* (2013.01); *D06F 58/22* (2013.01); *D06F 33/02* (2013.01); *D06F 2204/065* (2013.01); *D06F 2204/08* (2013.01); *D06F 2204/088* (2013.01)

(58) Field of Classification Search

CPC ..... D06F 25/00; D06F 35/005; D06F 39/02; D06F 39/022; D06F 58/22; D06F 2204/08

See application file for complete search history.

(56) References Cited

U.S. PATENT DOCUMENTS

| | | | |
|---|---|---|---|
| 1,530,073 | A | 3/1925 | Cutter |
| 2,843,943 | A | 7/1958 | Geldhof et al. |
| 2,892,335 | A | 6/1959 | Gray, Jr. |
| 2,959,044 | A | 11/1960 | Stone |
| 3,757,543 | A | 9/1973 | Braga |
| 3,896,641 | A | 7/1975 | Worst |
| 4,115,485 | A | 9/1978 | Genessi |
| 5,359,744 | A | 11/1994 | Kimball et al. |
| 5,588,313 | A | 12/1996 | Hildebrand |

(Continued)

FOREIGN PATENT DOCUMENTS

| | | | |
|---|---|---|---|
| EP | 0870859 | A1 | 10/1998 |
| EP | 2843100 | A1 | 3/2015 |
| GB | 2262595 | A | 6/1993 |

*Primary Examiner* — Joseph L. Perrin

(74) *Attorney, Agent, or Firm* — McGarry Bair PC

(57) ABSTRACT

A method of removing lint from drying air in a laundry treating appliance having a treating chamber for holding clothes for treatment according to a cycle of operation, a treating chemistry dispenser fluidly coupled to the treating chamber, and an air supply having an inlet and outlet fluidly coupled to the treating chamber is disclosed. The method includes a laundry treating phase including supplying treating chemistry from the treating chemistry dispenser to the treating chamber and leaving a portion of the treating chemistry within the treating chamber to form a bath of treating chemistry, a laundry drying phase including supplying air to the treating chamber through the inlet and exhausting the supplied air from the treating chamber.

18 Claims, 9 Drawing Sheets

(56) References Cited

U.S. PATENT DOCUMENTS

| | | | |
|---|---|---|---|
| 5,628,122 | A | 5/1997 | Spinardi |
| 7,412,853 | B2 | 8/2008 | Hong et al. |
| 7,707,860 | B2 | 5/2010 | Hong et al. |
| 8,196,441 | B2 | 6/2012 | Hendrickson et al. |
| 8,388,695 | B2 | 3/2013 | Hendrickson et al. |
| 8,397,328 | B2 | 3/2013 | Hendrickson et al. |
| 8,397,544 | B2 | 3/2013 | Hendrickson |
| 8,438,881 | B2 | 5/2013 | Ihne et al. |
| 8,813,526 | B2 | 8/2014 | Doyle et al. |
| 2006/0037213 | A1 | 2/2006 | Kajihara et al. |
| 2006/0075790 | A1 | 4/2006 | Jeon et al. |
| 2010/0000264 | A1 | 1/2010 | Luckman et al. |

LAUNDRY TREATING APPLIANCE LINT FILTER

CROSS-REFERENCE TO RELATED APPLICATIONS

The present application represents a divisional application of U.S. patent application Ser. No. 14/687,065 entitled "LAUNDRY TREATING APPLIANCE LINT FILTER," filed Apr. 15, 2015, now U.S. Pat. No. 9,725,845, issued on Aug. 8, 2017, which is incorporated herein by reference in its entirety.

BACKGROUND OF THE INVENTION

Laundry treating appliances, such as clothes dryers, washers, refreshers, and non-aqueous systems, may have a configuration based on a cabinet within which is housed the components of the appliance, including a tub. The tub may house a rotating drum that defines a treating chamber in which laundry items are placed for treating during a cycle of operation. During treating, lint from the laundry items may be captured by a filter element which may be removable for manual cleaning between cycles of operation.

BRIEF DESCRIPTION OF THE INVENTION

According to an embodiment of the invention, a method of removing lint from drying air in a laundry treating appliance having a treating chamber for holding clothes for treatment according to a cycle of operation, a treating chemistry dispenser fluidly coupled to the treating chamber, and an air supply having an inlet and outlet fluidly coupled to the treating chamber is disclosed. The method comprises a laundry treating phase comprising supplying treating chemistry from the treating chemistry dispenser to the treating chamber and leaving a portion of the treating chemistry within the treating chemistry dispenser to form a bath of treating chemistry, a laundry drying phase comprising, supplying air to the treating chamber through the inlet, exhausting the supplied air from the treating chamber, and directing the exhausted air to the dispenser to flow over the bath of treating chemistry to remove lint contained within the exhausted air.

According to an embodiment of the invention, a laundry treating appliance for treating laundry according to a cycle of operation comprises a treating chamber in which laundry may be placed for treatment according to the cycle of operation, a dispenser having a treating chemistry conduit fluidly coupling the dispenser to the treating chamber, a lint filter comprising a bath tub located within the dispenser and an air circuit comprising an air supply conduit coupled to the treating chamber and an air exhaust conduit having at least a portion coupled to the dispenser and in fluid communication with the bath tub. At least a portion of the liquid treating chemistry dispensed from the dispenser is retained in the bath tub to form a bath of treating chemistry and the air supplied from the exhaust conduit to the dispenser contacts the bath of treating chemistry such that at least some of the lint entrained in the air is retained in the bath of treating chemistry.

DESCRIPTION OF EMBODIMENTS OF THE INVENTION

Figure 1:
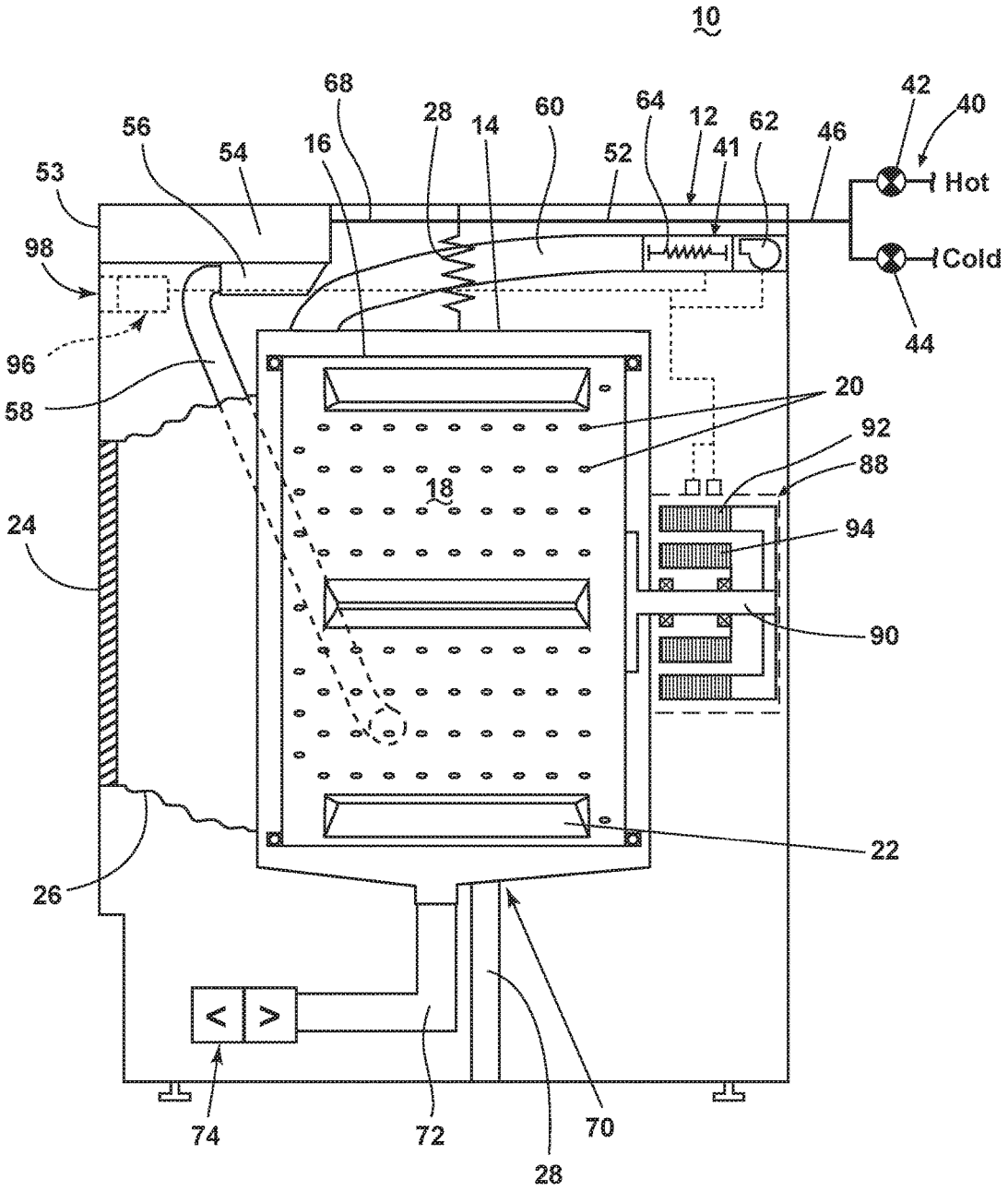
FIG. 1 is a schematic side sectional view of a laundry treating appliance according to an embodiment of the invention.

FIG. 1 is a schematic view of a laundry treating appliance according to a first embodiment of the invention. The laundry treating appliance may be any appliance which performs a cycle of operation to clean, dry or otherwise treat items placed therein, non-limiting examples of which include a horizontal or vertical axis clothes washer or dryer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a combination washer and dryer 10, which may include a structural support system comprising a cabinet 12 which defines a housing within which a laundry holding system resides. The cabinet 12 may be a housing having a chassis and/or a frame, defining interior enclosing components typically found in a conventional washing or drying machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that gas or liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The combination washer and dryer 10 may further include a suspension system 28 for dynamically suspending the laundry holding system within the structural support system.

The combination washer and dryer 10 may further include a liquid supply system for supplying water to the combination washer and dryer 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling the valves 42 and 44. A diverter mechanism 49 may be a diverter valve having two outlets such that the diverter mechanism 49 may selectively direct a flow of liquid to one or both of two flow paths. The diverter mechanism 49 is located on a supply conduit 52 connected to the inlet conduit 46 and may direct the flow of liquid to a tub inlet conduit 47 which may be provided with a spray nozzle 45 configured to spray the flow of liquid into the tub 14. In this manner, water from the household water supply 40 may be supplied directly to the tub 14.

The combination washer and dryer 10 may also be provided with a dispensing system for dispensing treating chemistry to the treating chamber 18 for use in treating the laundry according to a cycle of operation. The dispensing system may include a dispenser 54 which may be a single use dispenser, a bulk dispenser or a combination of a single use and bulk dispenser. Non-limiting examples of suitable dispensers are disclosed in U.S. Pub. No. 2010/0000022 to Hendrickson et al., filed July 1, chamber 2008, now U.S. Pat. No. 8,196,441, issued Jun. 12, 2012, entitled "Household Cleaning Appliance with a Dispensing System Operable Between a Single Use Dispensing System and a Bulk Dispensing System," U.S. Pub. No. 2010/0000024 to Hendrickson et al., filed July 1, chamber 2008, now U.S. Pat. No. 8,388,695, issued Mar. 5, 2013, entitled "Apparatus and Method for Controlling Laundering Cycle by Sensing Wash Aid Concentration," U.S. Pub. No. 2010/0000573 to Hendrickson et al., filed July 1, chamber 2008, now U.S. Pat. No. 8,397,328, issued Mar. 19, 2013, entitled "Apparatus and Method for Controlling Concentration of Wash Aid in Wash Liquid," U.S. Pub. No. 2010/0000581 to Doyle et al., filed July 1, chamber 2008, now U.S. Pat. No. 8,813,526, issued Aug. 26, 2014, entitled "Water Flow Paths in a Household Cleaning Appliance with Single Use and Bulk Dispensing," U.S. Pub. No. 2010/0000264 to Luckman et al., filed July 1, chamber 2008, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed June 23, chamber 2009, now U.S. Pat. No. 8,397,544, issued Mar. 19, 2013, entitled "Household Cleaning Appliance with a Single Water Flow Path for Both Non-Bulk and Bulk Dispensing," and application Ser. No. 13/093,132, filed Apr. 25, 2011, now U.S. Pat. No. 8,438,881, issued May 14, 2013, entitled "Method and Apparatus for Dispensing Treating Chemistry in a Laundry Treating Appliance," which are herein incorporated by reference in full.

Regardless of the type of dispenser used, the dispenser 54 may be configured to dispense a treating chemistry directly to the tub 14 or mixed with water from the liquid supply system through a treating chemistry conduit 58. The dispenser 54 may receive liquid from a dispenser inlet conduit 43 connected to the supply conduit 52 via the diverter mechanism 49. The treating chemistry conduit 58 may connect to the tub 14 so as to fill the tub 14 with a treating chemistry to a desired level. Alternatively, the treating chemistry conduit 58 may include a dispensing nozzle configured to dispense the treating chemistry into the tub 14 in a desired pattern and under a desired amount of pressure. For example, the dispensing nozzle may be configured to dispense a flow or stream of treating chemistry into the tub 14 by gravity, i.e. a non-pressurized stream.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The combination washer and dryer 10 may also include a recirculation and drain system for recirculating liquid within the laundry holding system and draining liquid from the combination washer and dryer 10. Liquid supplied to the tub 14 through tub inlet conduit 47 and/or the treating chemistry conduit 58 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the combination washer and dryer 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the combination washer and dryer 10 and for the introduction of more than one type of treating chemistry.

An air system 41 may also be provided for the combination washer and dryer 10. The air system 41 supplies air to the treating chamber 18 and exhausts air from the treating chamber 18. The supplied air may be heated or not. The air system 41 may have an air supply portion that may form, in part, an air supply conduit 60, which has one end fluidly coupled to an inlet grill 63, and another end which may be in fluid communication with the treating chamber 18. An air mover or blower 62 may be fluidly coupled to the air supply conduit 60. Operation of the blower 62 blows air into the treating chamber 18. A heating element 64 may lie within the air supply conduit 60. If the heating element 64 is turned on, the supplied air will be heated prior to entering the drum 16.

The air system 41 may further include an air exhaust portion that may be formed in part by the treating chemistry conduit 58, the dispenser 54 and a dispenser air outlet 53. A lint filter 56 may be provided as the inlet from the treating chemistry conduit 58 to the dispenser 54. Alternatively, the lint filter 56 may be provided as the transition between the tub 14 and the treating chemistry conduit 58. Operation of the blower 62 exhausts air from the treating chamber 18 through the treating chemistry conduit 58, lint filter 56, dispenser 54 and dispenser air outlet 53 to ambient.

The air system 41 may further include various sensors and other components, such as a temperature sensor, which may be coupled to the air supply conduit 60. The temperature sensor may be used to aid in determining an inlet temperature. A temperature sensor may also be coupled to the treating chemistry conduit 58, with the temperature sensor being used to determine an outlet air temperature.

A moisture sensor may be positioned in the interior of the treating chamber 18 to monitor the amount of moisture of the laundry in the treating chamber 18. One example of a moisture sensor is a conductivity strip. The moisture sensor may be mounted at any location in the interior of the combination washer and dryer 10 such that the moisture sensor may be able to accurately sense the moisture content of the laundry.

The combination washer and dryer 10 also includes a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The combination washer and dryer 10 also includes a control system for controlling the operation of the combination washer and dryer 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the combination washer and dryer 10. For example, the controller 96 may include the machine controller and a motor controller. Many known types of controllers may be used for the controller 96. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
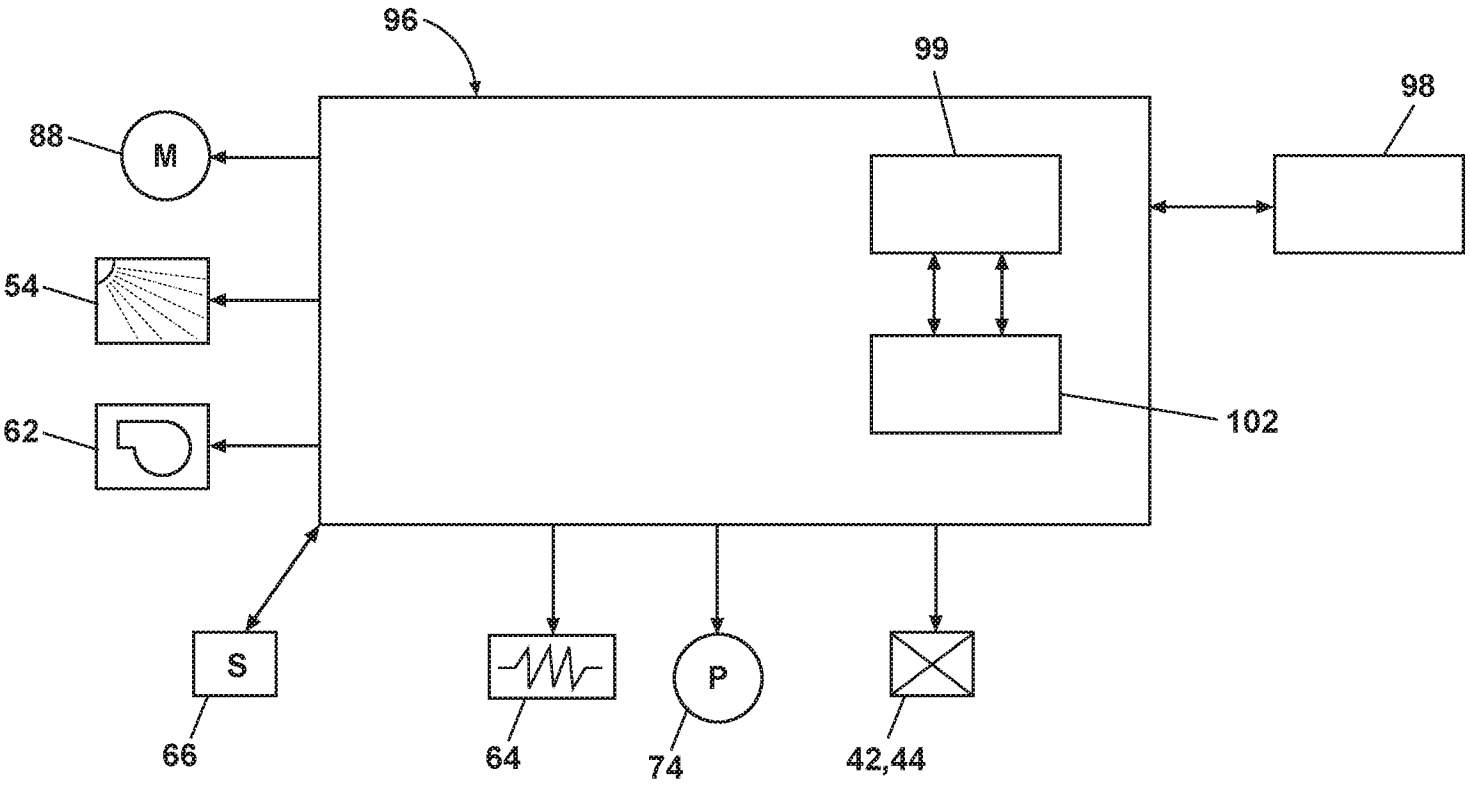
FIG. 2 is a schematic of a control system of the laundry treating appliance of FIG. 1 according to an embodiment of the invention.

As illustrated in FIG. 2, the controller 96 may be provided with a memory 99 and a central processing unit (CPU) 102. The memory 99 may be used for storing the control software that is executed by the CPU 102 in completing a cycle of operation using the combination washer and dryer 10 and any additional software. Examples, without limitation, of cycles of operation include: wash, heavy duty wash, delicate wash, quick wash, pre-wash, refresh, rinse only, timed wash, super delicate, heavy duty, normal dry, damp dry, sanitize, quick dry, timed dry, and jeans. The memory 99 may also be used to store information, such as a database or table, and to store data received from one or more components of the combination washer and dryer 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the combination washer and dryer 10 for communicating with and controlling the operation of the component to complete a cycle of operation. For example, the controller 96 may be operably coupled with the motor 88, the pump 74, the dispenser 54, the blower 62, the heater 64, the valves 42, 44 and the diverter mechanism 49 and/to control the operation of these and other components to implement one or more of the cycles of operation.

The controller 96 may also be coupled with one or more sensors 66 provided in one or more of the systems of the combination washer and dryer 10 to receive input from the sensors, which are known in the art and not shown for simplicity. Non-limiting examples of sensors 66 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

In one example, one or more sensors 66 may also be included in the combination washer and dryer 10 and may be positioned in any suitable location for detecting the amount of laundry, either quantitative (inertia, mass, weight, etc.) or qualitative (small, medium, large, etc.) within the treating chamber 18. By way of non-limiting example, it is contemplated that the amount of laundry in the treating chamber may be determined based on the weight of the laundry and/or the volume of laundry in the treating chamber. Thus, the one or more sensors 66 may output a signal indicative of either the weight of the laundry load in the treating chamber 18 or the volume of the laundry load in the treating chamber 18.

The one or more sensors 66 may be any suitable type of sensor capable of measuring the weight or volume of laundry in the treating chamber 18. Non-limiting examples of sensors 66 for measuring the weight of the laundry may include load volume, pressure, or force transducers which may include, for example, load cells and strain gauges. It has been contemplated that the one or more such sensors 66 may be operably coupled to the suspension system 28 to sense the weight borne by the suspension system 28. The weight borne by the suspension system 28 correlates to the weight of the laundry loaded into the treating chamber 18 such that the sensors 66 may indicate the weight of the laundry loaded in the treating chamber 18. In the case of the suitable sensors 66 for determining volume it is contemplated that an IR or optical based sensor may be used to determine the volume of laundry located in the treating chamber 18.

Alternatively, it has been contemplated that the amount of laundry within the treating chamber 18 may be determined based on motor sensor output, such as output from a motor torque sensor. The motor torque is a function of the inertia of the rotating drum and laundry. There are many known methods for determining the load inertia, and thus the load mass, based on the motor torque. It will be understood that the details of the load amount sensors are not germane to the embodiments of the invention and that any suitable method and sensors may be used to determine the amount of laundry.

The previously described combination washer and dryer 10 may be used to implement one or more embodiments of the invention. The embodiments of the method of the invention may be used to control the operation of the combination washer and dryer 10 to control the speed of the motor 88 to control the movement of the laundry within the laundry treating chamber 18 to provide a desired mechanical drying and cleaning action.

FIGS. 3-9C illustrate components of a combination washer and dryer of according to an embodiment of the invention where like elements from FIG. 1 are identified with the same reference numerals increased by 100.

Figure 3:
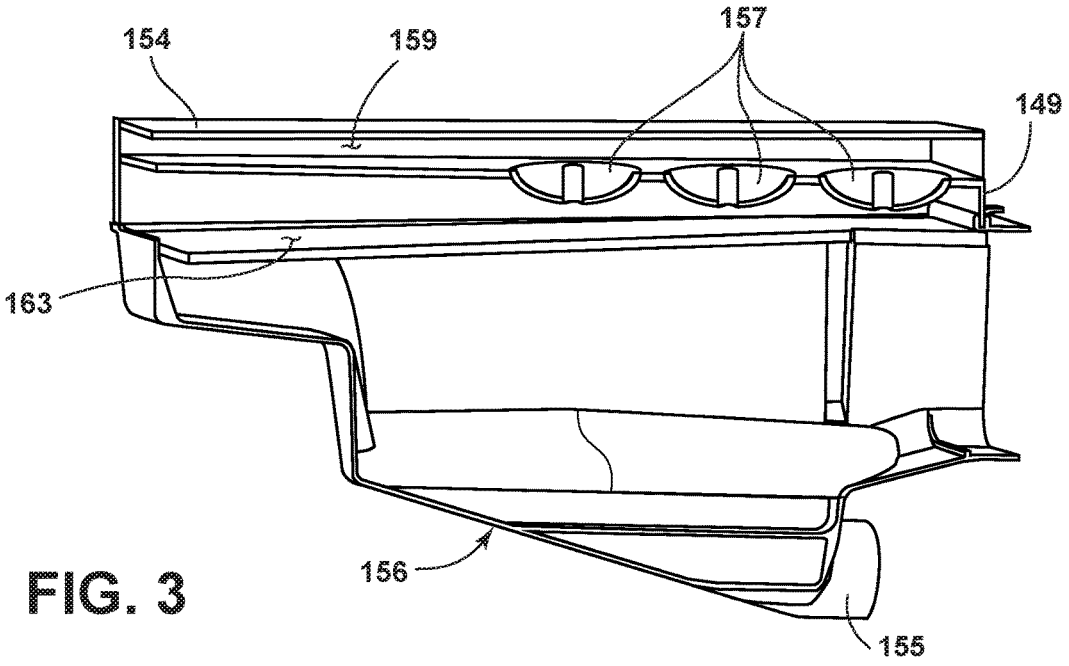
FIG. 3 is a side view of a dispenser and lint filter according to an embodiment of the invention.

Referring now to FIG. 3, there is shown a side view of a dispenser 154 and lint filter 156 according to an embodiment of the invention. The dispenser 154 may by integrally formed with the lint filter 156 and may comprise an upper flow channel 159 and a lower flow channel 163 separated by treating chemistry dispensing reservoirs 157. The dispenser 154 may also comprise a drawer 149 slidably received within the dispenser 154 such that the dispensing reservoirs 157 are disposed within the drawer 149.

Figure 4:
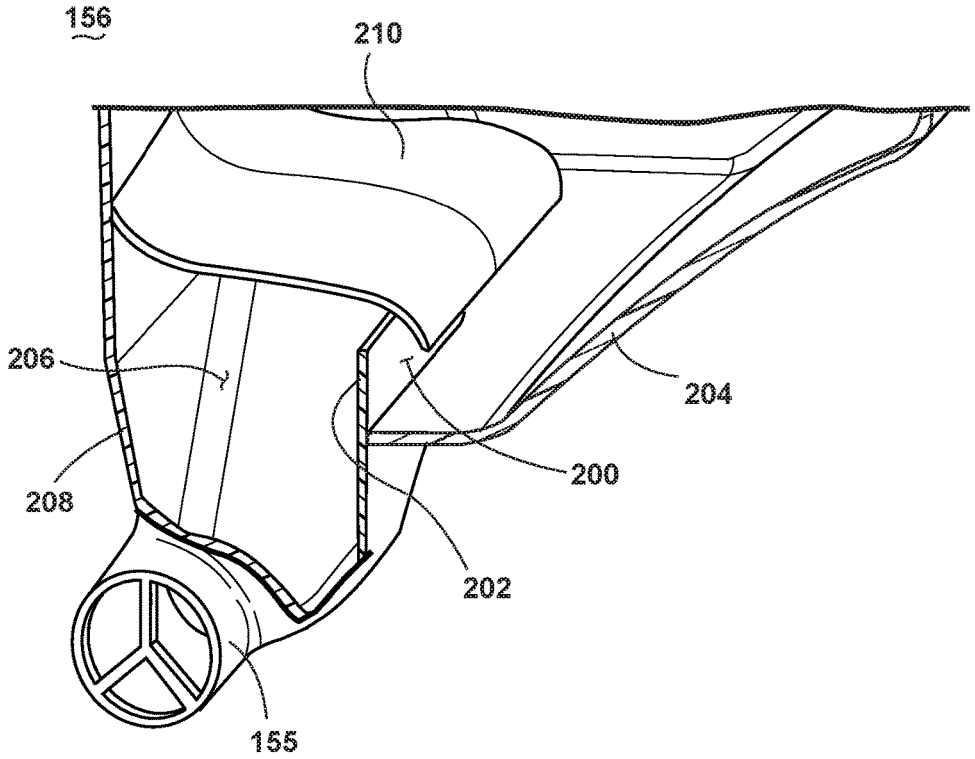
FIG. 4 is a perspective partial sectional view of a lint filter according to an embodiment of the invention.

FIG. 4 shows a partial perspective sectional view of the lint filter 156. The lint filter 156 comprises first and second housing walls 204, 208, a fluid retaining wall 202 and an air directing deflector 210 which are configured to define a lower chamber 206, a treating chemistry chamber or bath tub chamber 200 and an upper chamber 211. The lower chamber 206 is defined by the second housing wall 208, the deflector 210 and the retaining wall 202 and is fluidly connected to the port 155. The bath tub chamber 200 is disposed within a bath tub defined by the first housing wall 204 and the retaining wall 202 and is fluidly connected to the lower chamber 206 and the upper chamber 211. The upper chamber is defined by first and second housing walls 204, 208 and the deflector 210 and is fluidly coupled to the bath tub chamber 200 and the dispenser.

Figure 5:
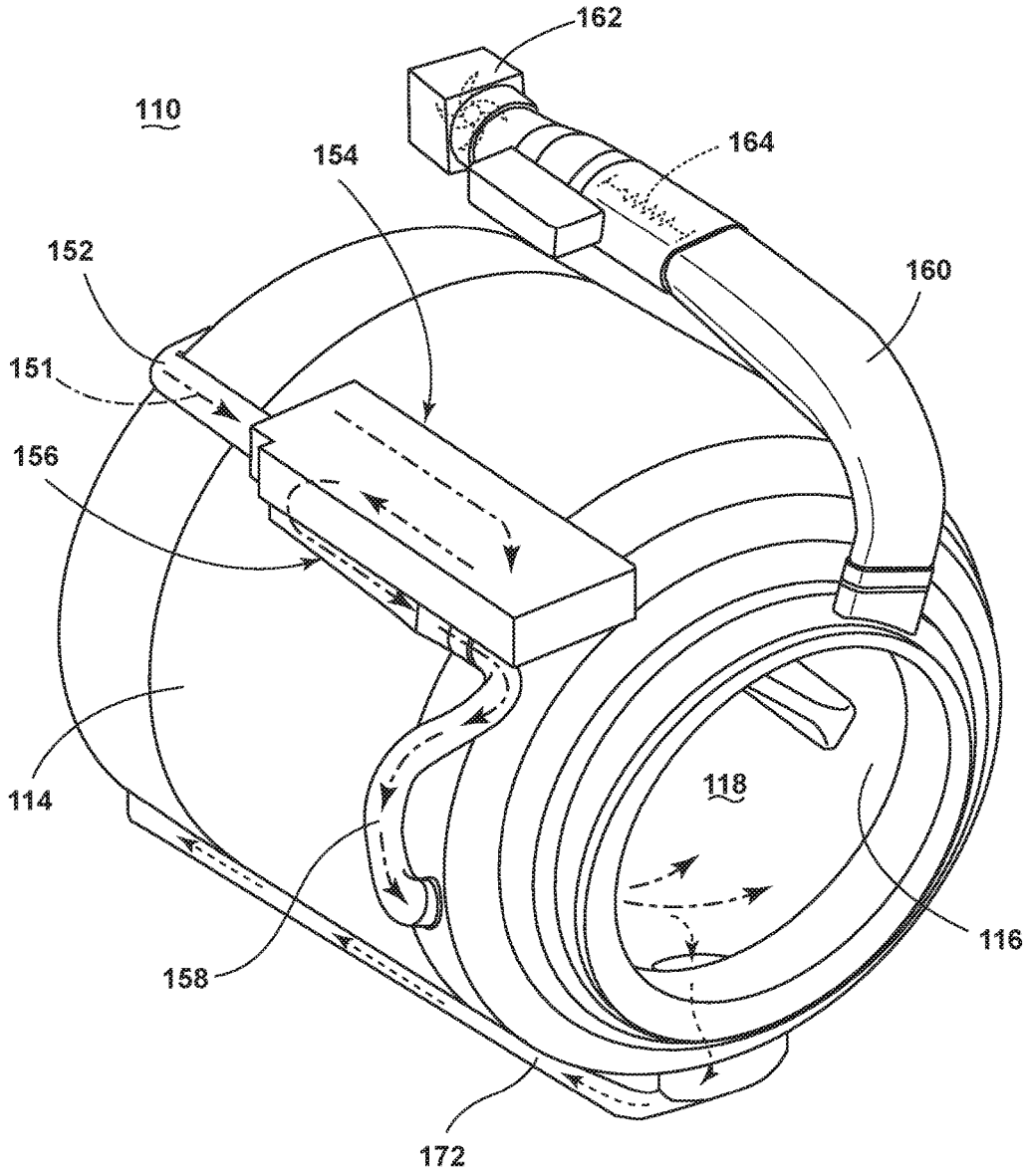
FIG. 5 is a perspective view of a portion of a laundry treating appliance during a laundry treating phase according to an embodiment of the invention.

Referring now to FIG. 5, there is shown a perspective view of the combination washer and dryer 110 during a laundry treating phase wherein portions have been removed to illustrate the flow of treating chemistry indicated by arrows 151 into and out of the treating chamber 118 according to an embodiment of the invention. During the laundry treating phase, water, which may be the treating chemistry enters the dispenser 154 through the supply conduit 152, mixes with additional treating chemistry or treating additives disposed in the dispenser 154, and flows out of the dispenser 154 into the lint filter 156. The treating chemistry then exits the lint filter 156 into the treating chamber 118 via the treating chemistry conduit 158. The treating chemistry then enters the sump 170 and is selectively drained or recirculated through the sump conduit 172.

Figure 6:
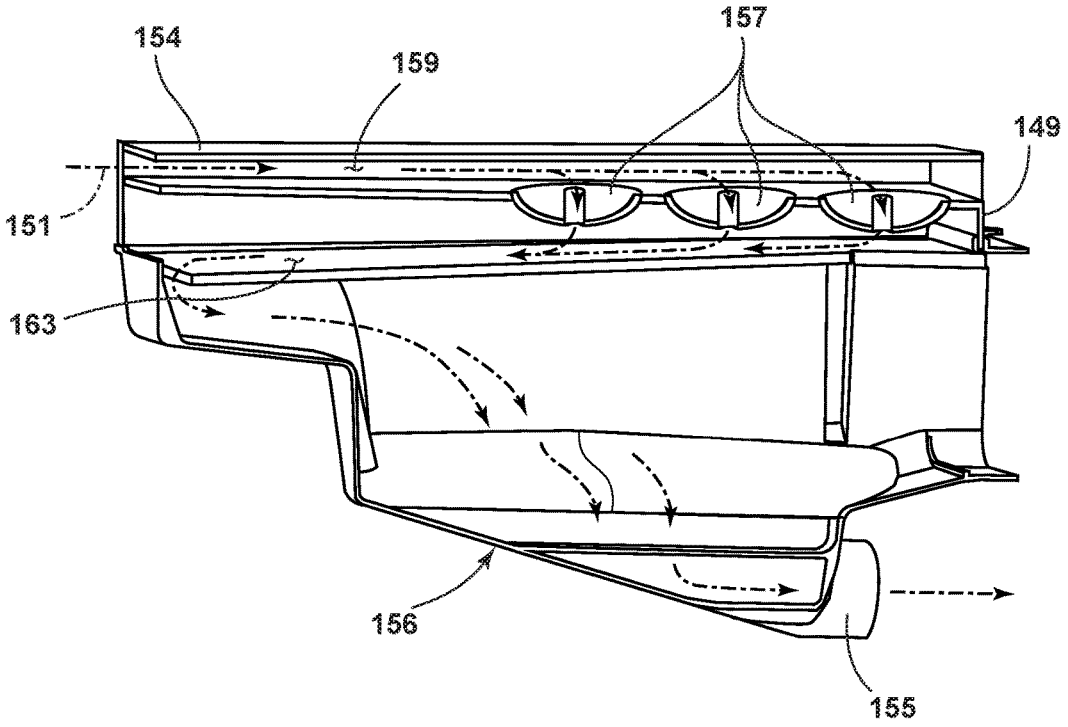
FIG. 6 is a side view of a dispenser during a laundry treating phase with portions removed for clarity according to an embodiment of the invention

As seen in FIG. 6 the dispensing reservoirs are configured to receive treating additives to be mixed with the treating chemistry. The treating chemistry enters the upper flow channel 159 as indicated by arrows 151 and flows through the dispensing reservoirs 157 into the lower flow channel 163 so as to carry treating additives contained in the dispensing reservoirs 157 with the treating chemistry into the lower flow channel 163. The treating chemistry then travels into the lint filter 156 and exits the lint filter 156 through port 155. It will be understood that the dispenser 154 as illustrated is by way of example and that any dispenser may be used as described above.

Figure 7:
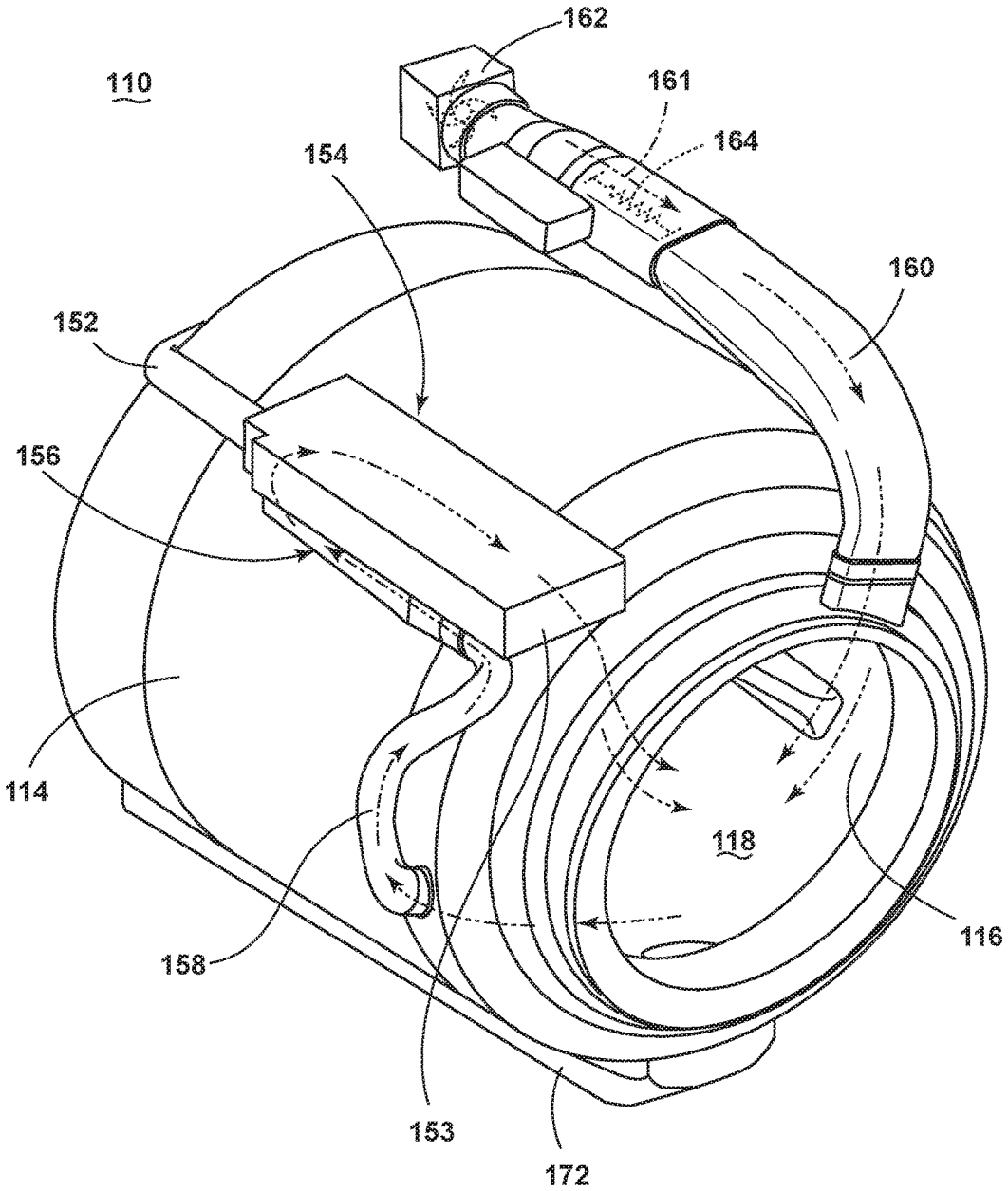
FIG. 7 is a perspective view of a portion of a laundry drying appliance during a laundry treating phase according to an embodiment of the invention.

Referring now to FIG. 7, there is shown a perspective view of the combination washer and dryer 110 during a laundry drying phase wherein portions have been removed to illustrate the flow of air through an air circuit indicated by arrows 161 supplied to the treating chamber 118 and exhausted from the treating chamber 118 according to an embodiment of the invention. Air is forced into treating chamber 118 through the air supply conduit 160 past the heater 164 by the blower 162. After circulating in the treating chamber 118, the air travels through the treating chemistry conduit 158 which defines an exhaust conduit, lint filter 156 and dispenser 154 where it is exhausted through the dispenser air outlet 153.

Figure 8:
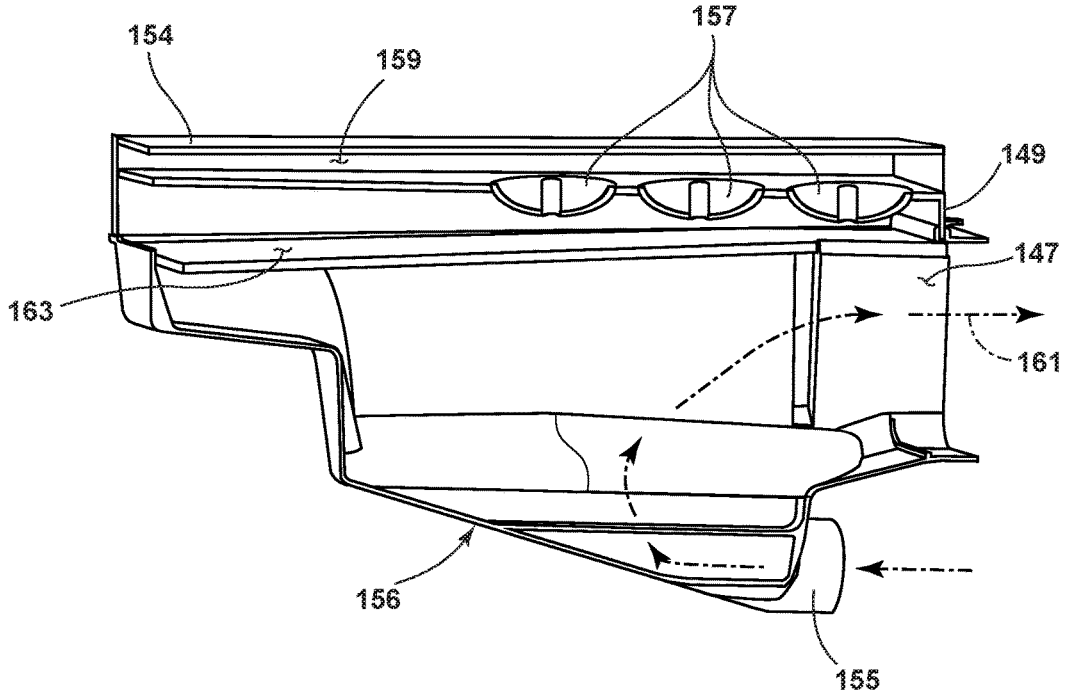
FIG. 8 is a side view of a dispenser during a laundry drying phase with portions removed for clarity according to an embodiment of the invention

As seen in FIG. 8, the flow of exhaust air enters the port 155 and flows through the lint filter 156 into an exhaust chamber 147 formed beneath the drawer 149 where it is exhausted to ambient via the dispenser air outlet.

The laundry treating phase shown in FIG. 5 and the laundry drying phase shown in FIG. 7 may define a single cycle of operation or separate cycles of operation.

Figure 9A:
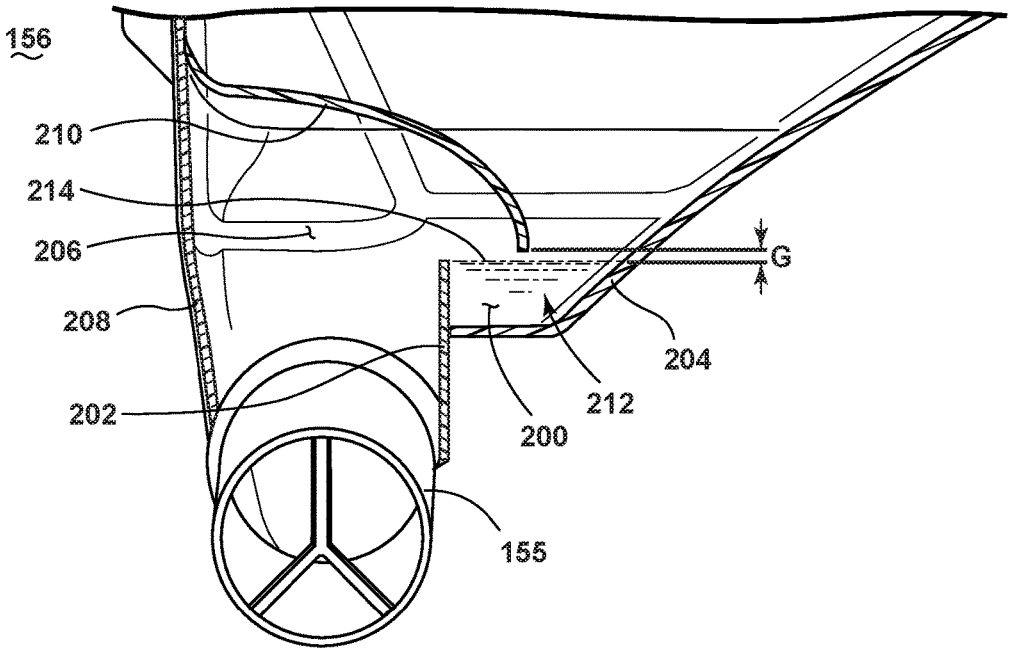
FIGS. 9A-9C are front views of a lint filter during a cycle of operation according to an embodiment of the invention.
Figure 9B:
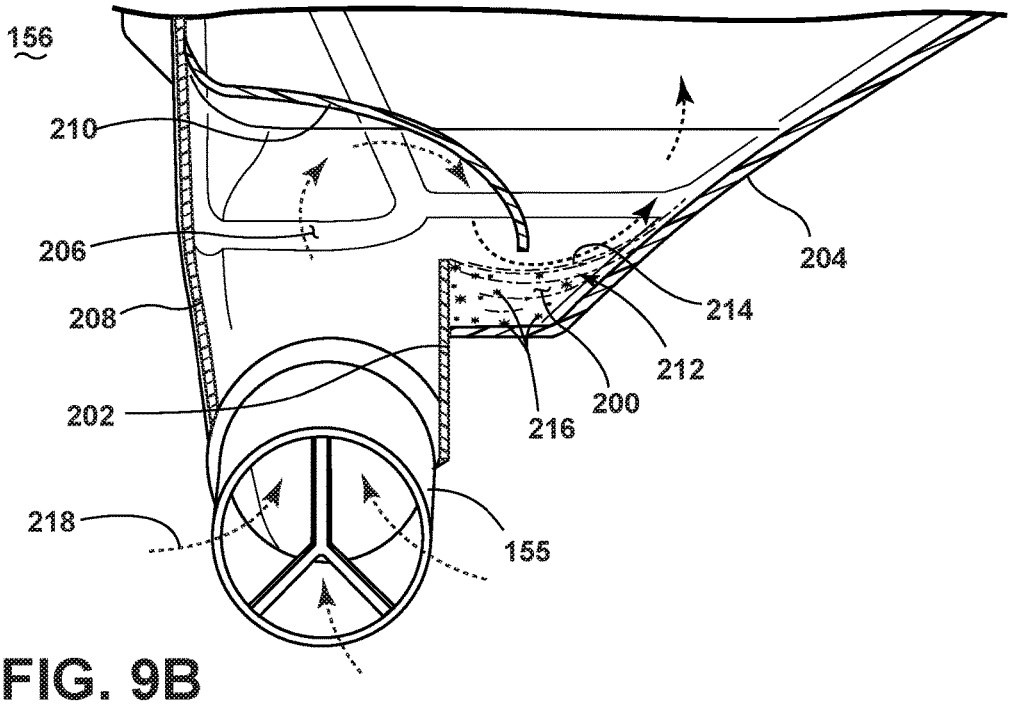

Referring now to FIGS. 9A and 9B, during the laundry treating phase or a dedicated filling phase, the treating chemistry flows through the lint filter 156 wherein a volume of treating chemistry is retained in the bath tub chamber 200 to form a bath 212 of treating chemistry. A free surface 214 of the bath 212 is level with an upper edge of the retaining wall 202 and forms a gap G with a lower edge of the deflector 210. As lint laden exhaust air, indicated by arrow 218 enters the port 155 during the laundry drying phase, it flows into the lower chamber 206 and is then deflected by the deflector 210 onto the bath 212 through the gap G into the upper chamber 211, impinging the exhaust air on the bath 212 which induces the lint laden exhaust air to deposit lint 216 in the bath 212.

The turbulence and an impingement vector of the exhaust air on the bath 212 corresponds to velocity of the of the exhaust air traveling over the bath 212 and directly affects the amount of lint 216 deposited in the bath 212. The velocity of the exhaust air over the bath is a function of the gap G which creates a pressure drop between the lower chamber 206 and upper chamber 211 to increase the velocity of the exhaust air over the bath 212, the volumetric flow rate of the blower and the geometry of the housing walls 204, 208 and the deflector 210. The volumetric flow rate of the blower, the geometry of the housing walls 204, 208 and the deflector 210 and the size of the gap G may be configured to achieve an optimized velocity of the exhaust air over the bath 212 to induce the lint 216 to be deposited in the bath 212. According to one embodiment, the velocity of the exhaust air over the bath 212 may range between 14 ft/s and 42 ft/s.

The amount of lint 216 deposited in the bath 212 also corresponds to the free surface 214 surface area of the bath 212. The exhaust air traveling over the bath 212 forms a standing wave on the free surface 214, thereby increasing the free surface 214 surface area of the bath 212 and increasing the amount of lint 216 deposited in the bath 212. The surface area of the free surface 214 may also be increased by optimizing the geometry of the retaining wall 202 and first housing wall 204 which define the bath tub chamber 200.

Figure 9C:
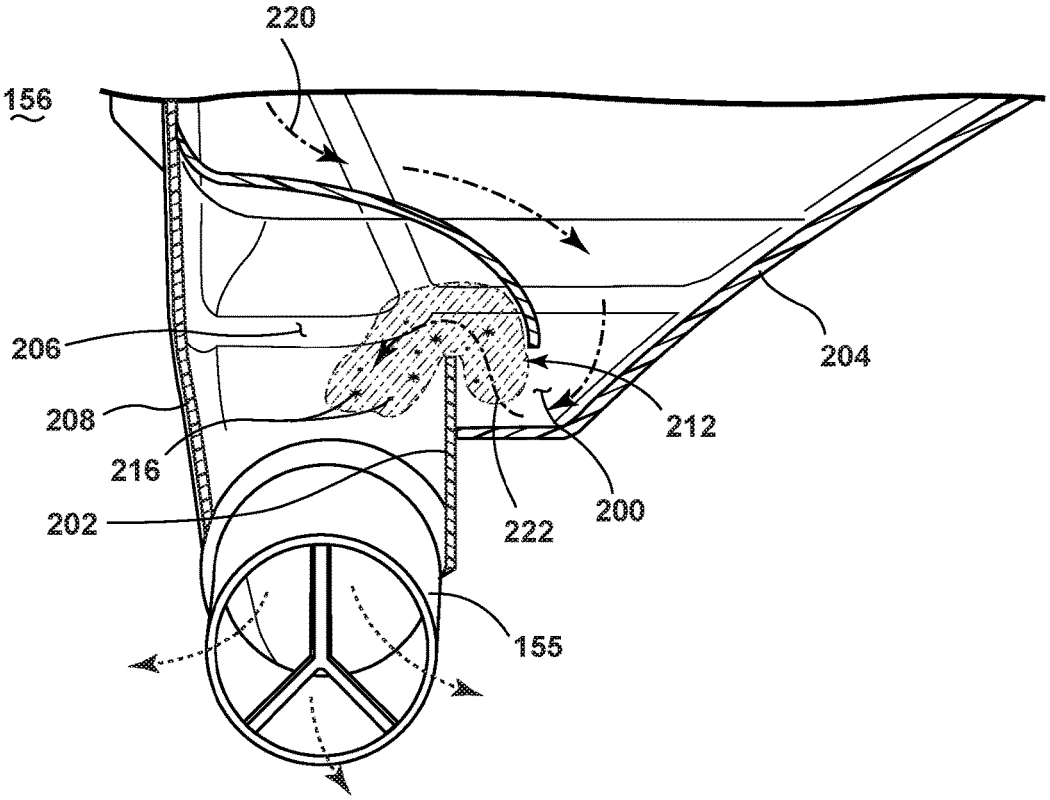

FIG. 9C shows the lint laden bath 212 being flushed from the bath tub chamber 200. After a predetermined amount of laundry drying phases, a subsequent laundry treating phase or a dedicated flushing phase before a subsequent laundry treating phase produces a flow of treating chemistry or liquid as indicated by arrows 220 that flows through the lint filter 156 and flushes the bath 212 of treating chemistry containing the lint 216 from the bath tub chamber 200. The bath 212 of treating chemistry containing the lint 216 is thus removed from the bath tub chamber 200 and flows out of the lint filter 156 through the port 155. The removed lint 216 and bath 212 may then flow into the sump and be selectively drained through the sump conduit. A volume of the treating chemistry or liquid from the subsequent laundry treating phase or the dedicated flushing phase, flushing the lint 216, is retained in the bath tub chamber 200 to form a new bath of treating chemistry or liquid in the bath tub chamber 200 that is absent of lint 216. It will be understood that the subsequent laundry treating phase or the dedicated flushing phase may flush the bath tub chamber 200 multiple times to remove all of the lint 216. Once the lint 216 is removed, a subsequent drying phase may occur wherein lint from the exhaust air may be deposited in the new bath.

In one embodiment, the laundry treating phase may comprise a wash cycle, rinse cycle and extraction cycle. The flushing of the bath tub chamber 200 may occur prior to the wash cycle by running water or treating chemistry through the lint filter and into the sump and then draining the lint laden water or treating chemistry from the sump. Alternatively, the flushing of the bath tub chamber 200 may occur during the wash cycle, the rinse cycle or the extraction cycle or during a dedicated flushing cycle before or after one of the wash cycle, rinse cycle or extraction cycle. Furthermore, the lint laden water or treating chemistry in the sump may be drained after each flush or after a predetermined amount of flushes.

In another embodiment, the flushing of the bath tub chamber 200 may occur during or after the laundry drying phase. During the laundry drying phase, the airflow may be temporality stopped, to allow a flow of treating chemistry such as water to flow through the lint filter 156 and bath tub chamber 200 in order to flush the bath 212 and lint 216 into the sump of the combination washing and dryer. After flushing, the airflow may be resumed. This may occur multiple times throughout the laundry drying phase as needed. Furthermore, the lint laden water or treating chemistry in the sump may be drained after each flush or after a predetermined amount of flushes.

The washing machine disclosed herein provides a plurality of benefits including that the laundry treating appliance provides a lint filter that is perpetually self-cleaning. By using the treating chemistry supplied by the dispenser, a sufficient amount of treating chemistry flushed into the lint filter during a laundry treating phase forms a bath that acts to remove lint from exhaust air traveling over the bath during a laundry drying phase. The lint is then contained in the bath and may be flushed out during subsequent laundry treating phases or a dedicated flush routine such that a user never has to manually remove the lint from the lint filter.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of removing lint from drying air in a laundry treating appliance having a treating chamber for holding clothes for treatment according to a cycle of operation, a treating chemistry dispenser having a housing with a port fluidly coupled to the treating chamber, a lint filter comprising a bath tub located within the treating chemistry dispenser, the lint filter defined by a portion of the housing and a retaining wall and fluidly coupled with the port, and an air supply having an inlet and outlet fluidly coupled to the treating chamber, the method comprising:

a laundry treating phase comprising supplying treating chemistry from the treating chemistry dispenser to the treating chamber and leaving a portion of the treating chemistry within the bath tub to form a bath of treating chemistry;

a laundry drying phase comprising:

supplying air to the treating chamber through the inlet;

exhausting the supplied air from the treating chamber; and directing the exhausted air to the lint filter within the treating chemistry dispenser to flow over the bath of treating chemistry to remove lint contained within the exhausted air.

2. The method of claim 1 wherein the laundry treating phase and the laundry drying phase are part of the same cycle of operation.

3. The method of claim 1 further comprising removing the bath of treating chemistry from the treating chemistry dispenser.

4. The method of claim 3 wherein the removing the bath of treating chemistry occurs after a predetermined number of laundry drying phases.

5. The method of claim 3 wherein the removing the bath of treating chemistry from the treating chemistry dispenser comprises flushing the treating chemistry dispenser with liquid.

6. The method of claim 5 further comprising draining the flushed liquid prior to a future laundry treating phase.

7. The method of claim 6 wherein the future laundry treating phase is the next laundry treating phase.

8. The method of claim 5 further comprising draining the flushed treating chemistry from the laundry treating appliance.

9. The method of claim 8 wherein the draining of the flushed treating chemistry occurs during the laundry treating phase.

10. The method of claim 1 wherein the directing the exhausted air to the treating chemistry dispenser to flow over the bath of treating chemistry forms a standing wave on the bath of treating chemistry.

11. The method of claim 1 wherein the directing the exhausted air to the lint filter within the treating chemistry dispenser to flow over the bath of treating chemistry comprises directing the exhausted air between 14 ft/s and 42 ft/s over the bath of treating chemistry.

12. The method of claim 1 wherein directing the exhausted air to the treating chemistry dispenser comprises directing the exhausted air into the housing of the treating chemistry dispenser.

13. The method of claim 12 wherein directing the exhausted air into the housing comprises directing the exhausted air into the housing at a location away from a treating chemistry dispensing drawer slidably received within the housing.

14. The method of claim 13 wherein the exhausted air is directed into the housing below the drawer.

15. The method of claim 1 wherein the treating chemistry comprises at least water.

16. The method of claim 1 wherein the laundry drying phase further comprises directing the exhausted air to the lint filter to flow over and impinge on the bath of treating chemistry to remove lint contained within the exhausted air.

17. The method of claim 1 wherein the laundry drying phase further comprises directing the exhausted air to the lint filter such that the flow is deflected onto the bath of treating chemistry to remove lint contained within the exhausted air.

18. The method of claim 1 wherein the flow of the exhausted air over the bath of treating chemistry induces laden lint contained within the exhausted air to be deposited in the bath of treating chemistry.

* * * * *